United States Patent [19]

Nakamura

[11] 4,064,930

[45] Dec. 27, 1977

[54] CONTINUOUS CASTING METHOD USING A LADLE BOGIE

[75] Inventor: Shoji Nakamura, Hirakata, Japan

[73] Assignee: Kyoei Steel Ltd., Osaka, Japan

[21] Appl. No.: 765,405

[22] Filed: Feb. 3, 1977

[30] Foreign Application Priority Data

July 8, 1976 Japan ..... 51-81791

[51] Int. Cl.[2] ..... B22D 11/10

[52] U.S. Cl. ..... 164/82; 164/438

[58] Field of Search ..... 164/82, 136, 281, 337

[56] References Cited

U.S. PATENT DOCUMENTS 3,273,208 9/1966 Greenberger ..... 164/281

FOREIGN PATENT DOCUMENTS 2,207,768 6/1974 France ..... 164/281

*Primary Examiner*—Robert D. Baldwin

*Attorney, Agent, or Firm*—Wenderoth, Lind & Ponack

[57] ABSTRACT

A method of continuous casting using a crane and a ladle bogie which is adapted to travel between the ladle shunting position and the position right above a tundish, whereby a ladle emptied and a ladle filled with molten steel are exchanged quickly, without a break in the teeming operation.

1 Claim, 3 Drawing Figures

CONTINUOUS CASTING METHOD USING A LADLE BOGIE

This invention relates to a method of continuous casting, whereby in the process of pouring molten steel from a ladle into a tundish of a continuous casting machine a ladle bogie and a crane are used to quickly exchange an emptied ladle for a ladle filled with molten steel, without a break in the teeming operation.

In general, when casting by using a continuous casting machine molten steel manufactured by means of an electric furnace, an open hearth furnace or the like is put in a ladle, which is conveyed by a crane to a ladle stand of the continuous casting machine, and the molten steel is poured (teemed) into a tundish. The ladle thus emptied is again craned and carried away from the ladle stand and then a ladle filled afresh with molten steel is supplied to said ladle stand. In this way, a ladle filled with molten steel and a ladle emptied are exchanged in repetition, by utilizing a crane.

The continuous casting method as mentioned above, however, requires time for transporting ladles when exchanging an emptied ladle for a ladle filled with molten steel and involves the interruption of the process of pouring molten steel from a tundish into a mold. Thus, the continuous casting operation is stopped temporarily, with the result of lowering of both productivity and work efficiency. In order to eliminate these defects, there have been proposed such systems as the turntable system and the system to utilize the ladle bogie. In these systems, however, a ladle filled with molten steel is placed on a turntable or a ladle bogie and is transferred to the position nearly right above a tundish. These systems, therefore, require large capacity for motive power, stand, foundation and so on, with resultant higher costs of equipment.

The present invention has been made to eliminate the above-mentioned disadvantages. It provides a method of continuous casting using a crane and a ladle bogie which is adapted to travel between the ladle shunting position and the position right above the tundish, which comprises the following steps, namely, (1) to place a ladle filled with molten steel on a stand right above a tundish by using the crane and then to teem steel; (2) when molten steel in the ladle has decreased to 20% to 10% of the full capacity of the ladle, the ladle is supported by the ladle bogie which is moved forward while pouring (teeming) is carried on; (3) to cause said ladle bogie to retreat to the ladle shunting position when said ladle was emptied entirely; and (4) to supply a new ladle filled with molten steel onto the stand right above the tundish by the crane, thus exchanging the ladles quickly in sequence so as to effect continuous teeming.

Figure 1:
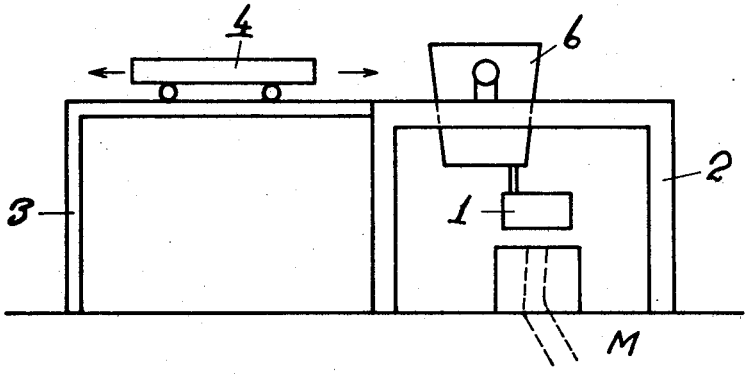
Figure 2:
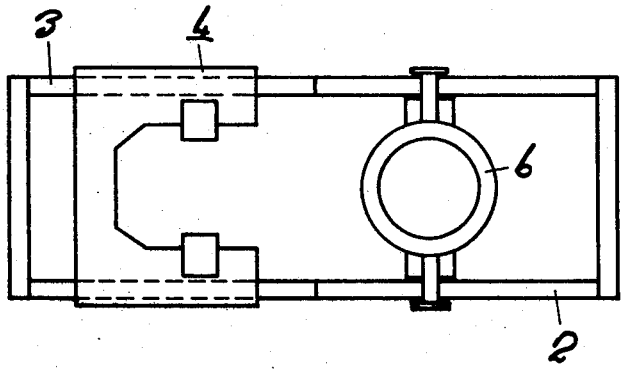
Figure 3:
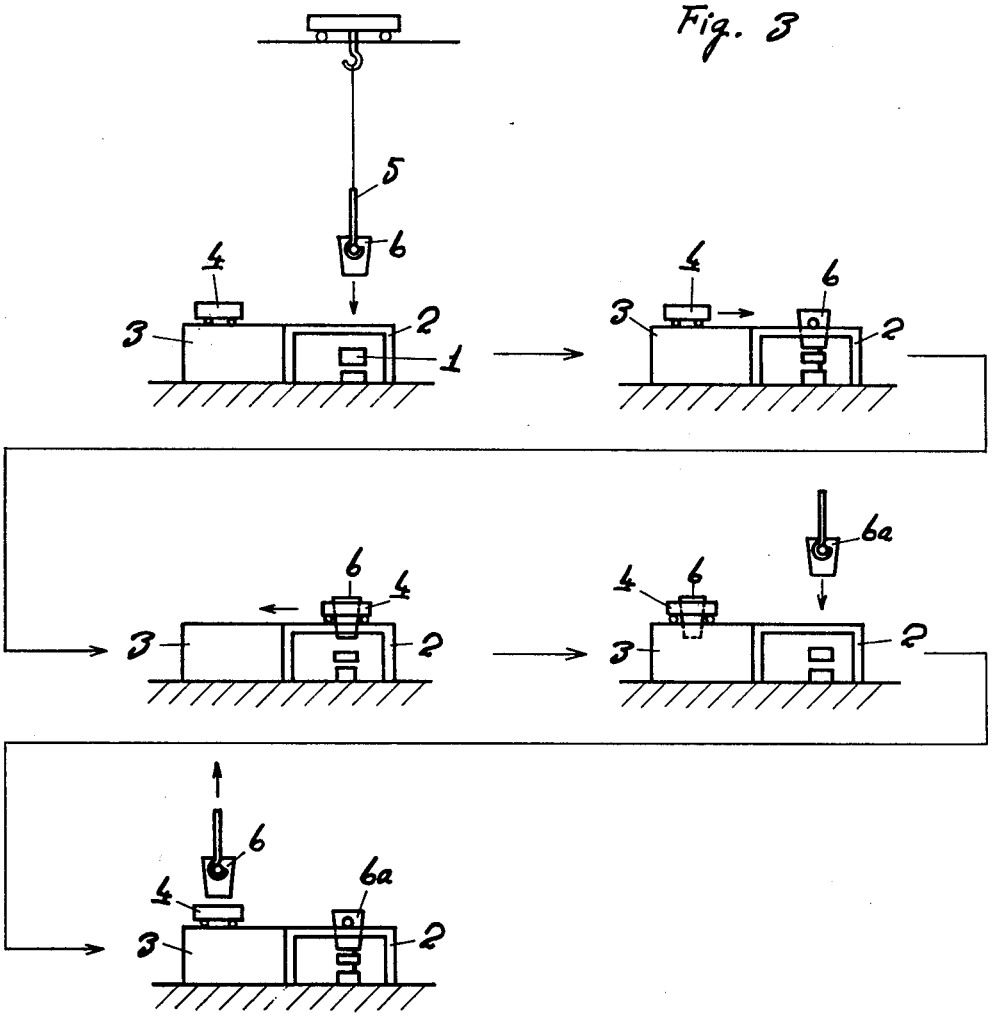

The present invention is described hereinafter with reference to a preferred embodiment and accompanying drawings, in which:

FIG. 1, FIG. 2 and FIG. 3 are a front view, a plan view and a detailed diagram, respectively, of an embodiment of the present invention.

In the drawings, numeral 1 denotes a tundish disposed above a mold M and numeral 2 denotes a ladle stand provided above the tundish 1. Arranged contiguous to one side of the ladle stand 2 is a stand 3 for bogie so that a ladle bogie 4 can travel between the ladle stand 2 and the stand 3 for bogie. Provided above these two stands 2, 3 is a ladle crane 5 (refer to FIG. 3), which is adpated to travel from the position above the two stands to the teeming position of an electric furnace or an open hearth furnace as it is carrying a ladle 6.

In the continuous casting equipment constituted as above, the continuous supply of molten steel to the tundish is carried out by the combination of the ladle bogie 4 and the crane. Firstly, the ladle 6 filled with molten steel is slung up by the crane 5 and is conveyed from the position of the electric furnace or the open hearth furnace onto the ladle stand 2. While the ladle 6 is supported by the ladle stand 2, molten steel contained in the ladle 6 is poured into the tundish 1. When the pouring from the ladle has prgressed by 80% and 90%, namely, molten steel still remaining in the ladle 6 is 20% to 10% of the full capcity of the ladle 6, the ladle bogie 4 ready for advance on the stand 3 for bogie is moved forward to support the ladle which is becoming empty, without causing a break in the operation of pouring molten steel into the tundish. Meanwhile, the ladle crane 5 slings up a succeeding ladle **6*a* filled with molten steel supplied from the electric furnace or the like and conveys it toward the ladle stand 2. As soon as the preceding ladle 6 is emptied entirely, it is caused to retrocede quickly, as it is supported by the ladle bogie 4, to the stand 3 for bogie and the ladle 6*a* hung by the crane 5 is supplied onto the ladle stand 2 so that molten steel is continuously poured into the tundish from the ladle 6*a*, following the ladle 6. Then the crane 5 slings up the empty ladle 6 on the ladle bogie 4**, transmits it to the electric furnace or the like to fill it with molten steel for subsequent exchange.

In the above case, it is ideal in improving the efficiency of the continuous casting to maintain the temperature of molten steel at or above the tolerance limit and, if possible, to do away with the waiting time for exchange, so that immedately after the ladle is filled with molten steel from the electric furnace or the like, the subsequent process or the process of replacing with an empty ladle can be effected. The present system is to repeat the above operations successively so as to supply molten steel continuously into the tundish.

According to the present invention, the ladle filled with molten steel is not placed on the ladle bogie at once but is placed on the ladle bogie when molten steel left therein has reduced to 20% to 10% of the full capacity of the ladle, while teeming is continued. Therefore, strength and self-propelling capacity of the ladle bogie can be covered by one-third to one-fourth of those of the conventional system. This leads to the reduction of the manufacturing costs of the bogie and the stand and also the installation expenses of the system. Because the system of the present invention provides quick exchange of ladles, the exchange of ladles does not interrupt the pouring of molten steel from the tundish to the mold and thus the so-called full continuous casting can be practised, which results in an improvement in the yield of finished goods, saving of the working personnel, and a reduction of the cost of refractories. As such, the system of the present invention possesses various advantages.

I claim:

1. A method of continuous casting using a crane and a ladle bogie which is adapted to travel between a ladle shunting position and a position right above a tundish, comprising the steps of:

a. disposing the bogie on a stand in the shunting position;

b. placing a ladle filled with molten steel on a stand right above a tundish by the use of a crane and then teeming steel;

c. causing the bogie to retreat to the shunting position and thereafter supplying a new ladle filled with molten steel onto the stand right above the tundish, thus exchanging ladles quickly for continuous teeming.

* * * * *